US006755244B1

(12) United States Patent
Koopmans

(10) Patent No.: US 6,755,244 B1
(45) Date of Patent: Jun. 29, 2004

(54) LUBRICATOR

(75) Inventor: Sietse Jelle Koopmans, Meer (BE)

(73) Assignee: ASEP Holding BV (NL)

( * ) Notice: Subject to any disclaimer, the term of this patent is extended or adjusted under 35 U.S.C. 154(b) by 0 days.

(21) Appl. No.: 09/762,444

(22) PCT Filed: Aug. 9, 1999

(86) PCT No.: PCT/GB99/02454

§ 371 (c)(1),
(2), (4) Date: Apr. 20, 2001

(87) PCT Pub. No.: WO00/08298

PCT Pub. Date: Feb. 17, 2000

(30) Foreign Application Priority Data

Aug. 7, 1998 (GB) ..... 9817099
Dec. 23, 1998 (GB) ..... 9828249

(51) Int. Cl.[7] ..... E21B 33/068
(52) U.S. Cl. ..... 166/70; 166/75.15
(58) Field of Search ..... 184/6, 15.1, 109; 166/377, 378, 379, 381, 385, 387, 75.11, 92.1, 196, 70, 175.15

(56) References Cited

U.S. PATENT DOCUMENTS 3,568,767 A * 3/1971 Weiss ..... 166/351
3,637,009 A * 1/1972 James ..... 166/351
3,639,972 A * 2/1972 Schelin et al. ..... 29/451
4,103,739 A * 8/1978 Hall ..... 166/105
4,361,947 A * 12/1982 Arnaud ..... 29/416
4,452,304 A * 6/1984 Barrier et al. ..... 166/70
4,476,933 A * 10/1984 Brooks ..... 166/324

FOREIGN PATENT DOCUMENTS

GB 1 247 098 * 9/1971
GB 2 313 610 * 12/1997

* cited by examiner

*Primary Examiner*—William C. Joyce
(74) *Attorney, Agent, or Firm*—Gifford, Krass, Groh, Sprinkle, Anderson & Citkowski, PP.C.

(57) ABSTRACT

A lubricator (10) includes a tubular body (12) through which passes a support member such as coil tubing or wireline, and an elongate slot (18) for inspection of or access to the support. A sleeve (20) mounted on the body (12) is movable between first and second positions to close or open the port (18). The sleeve (20) is movable by means of a pair of pistons and cylinders (22, 23, 24, 25). O-ring seals (28, 29) are provided on the body (12) above and below the slot (18).

19 Claims, 1 Drawing Sheet

LUBRICATOR

FIELD OF THE INVENTION

Figure 1:
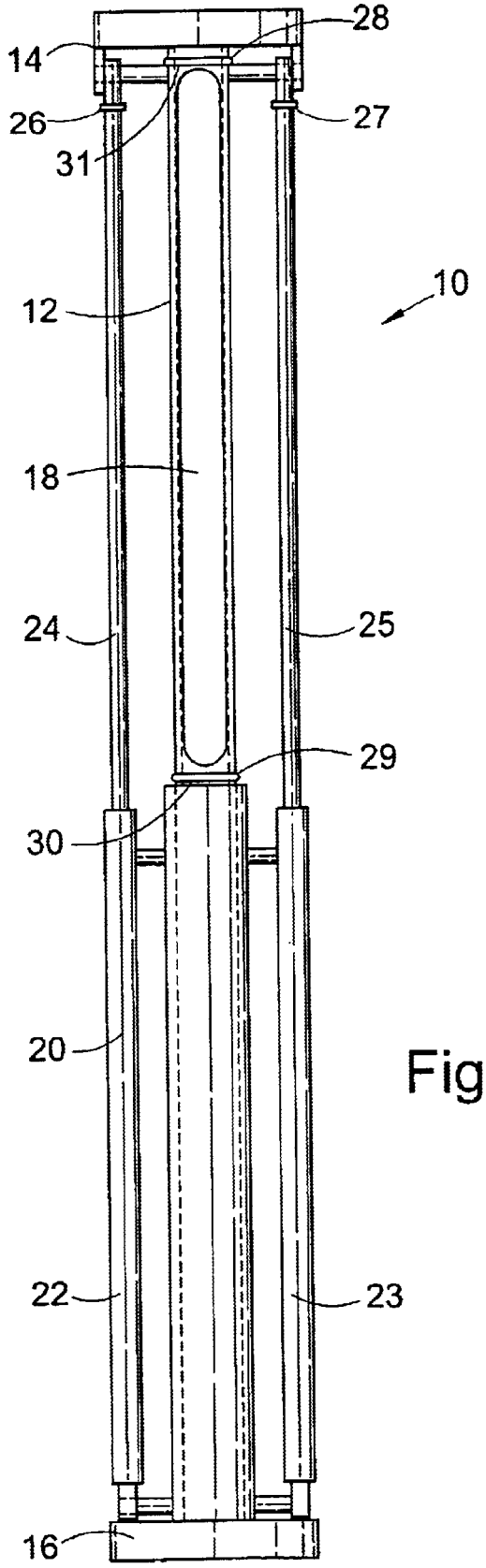

This invention relates to a lubricator, and in particular to a side access lubricator.

BACKGROUND OF THE INVENTION

In many downhole operations, such as carried out by those working in the oil and gas exploration and extraction industry, tools, valves, packers, sensors and other devices are run into and retrieved from well bores using flexible relatively small diameter supports, such as coil tubing, slickline or wireline. The support passes through a lubricator stuffing box and grease head comprising a tubular body which is mounted above an opening providing access into the well bore. The lubricator may be supported in a derrick or from a crane jib.

The lubricator provides a lock via which tools may be inserted into and retrieved from a well which is under pressure. To insert a tool, the well is closed below the lubricator and pressure within the lubricator is bled off. The lubricator may then be opened to receive the tool, which is coupled to the end of the support. The lubricator is then closed and the well opened below the lubricator, allowing the tool to be run into the well. Conventionally, the lubricator must be removed from its normal position above the well bore opening to permit opening and insertion of a tool, requiring derrick or crane intervention.

It is known to provide side access lubricators with hinged doors which may be opened to allow insertion and retrieval of tools without removal of the lubricator and thus without derrick or crane intervention.

It is among the objectives of embodiments of the present invention to provide an improved side access lubricator.

SUMMARY OF THE INVENTION

According to the present invention there is provided a lubricator comprising a tubular body defining a side access port, a tubular sleeve mounted on the body and movable between a first position in which a wall portion of the sleeve closes the body port, and a second position in which the body port is open, permitting access to the body interior.

The invention also relates to a method of locating or retrieving tools from such lubricators.

The use of a sleeve to close the body port facilitates sealing of the port.

Preferably, the body and sleeve are cylindrical.

Preferably also, the sleeve is movable between the first and second positions by one or both of rotation and axial movement relative to the body. Most preferably, the sleeve is axially movable relative to the body such that a seal between the body and the sleeve may be provided merely by the provision of, for example, two sets of annular seals either on the body above and below the body port, or adjacent the ends of the sleeve.

The sleeve may be moved between the first and second positions by any convenient means, and preferably by means of a piston and cylinder arrangement, and most preferably a pair of pistons and cylinders, one mounted to each side of the body and sleeve. of course other means may be utilised, for example a manual arrangement, or motor driven arrangements.

BRIEF DESCRIPTION OF THE INVENTION

This and other aspects of the invention will now be described, by way of example, with reference to the accompanying drawing in which:

FIG. 1 is a schematic side view of a lubricator in accordance with a preferred embodiment of the present invention.

DETAILED DESCRIPTION OF THE PREFERRED EMBODIMENT

The lubricator 10 comprises a tubular body 12 through which a support member, such as coil tubing, wireline or slickline, passes. Flanges 14, 16 are provided at the upper and lower ends of the body 12 for use in mounting the lubricator at an appropriate position on a rig. The upper portion of the body 12 defines an elongate port or slot 18 which may be utilised for inspection, insertion, or retrieval of tools and the like mounted on the support, without the requirement to remove the lubricator from the rig and thus avoiding the need for derrick or crane intervention.

Mounted on the body 12 is a sleeve or pipe 20 having an internal diameter slightly larger than the external diameter of the body 12. The pipe 20 is mounted between a pair of cylinders 22, 23, which cylinders 22, 23 are mounted on respective rods 24, 25 extending parallel to the body 12. Pistons (not shown) are defined on the rods 24, 25, within the cylinders 22, 23, such that supplying pressurised hydraulic fluid to the cylinders 22, 23 above the pistons lifts the cylinders 22, 23 and the pipe 20 relative to the body 12 until the cylinders 22, 23 come to rest against stops 26, 27 defined at the upper ends of the rods 24, 25. In the raised position, the pipe 20 closes the port or slot 18. To ensure pressure-tight closure of the slot 18, O-ring seals 28, 29 are provided in appropriate annular grooves 30, 31 in the body 12 above and below the slot 18.

It will be apparent to those of skill in the art that the lubricator 10 as described above provides a convenient arrangement for gaining access to, inserting, or retrieving tools and the like mounted on supports which pass through a lubricator and into a pressurised well. Further, the use of an axially movable sleeve or pipe to close the slot facilitates provision of a pressure-tight seal; internal body pressure acting on the pipe wall creates no net axial or radial force on the pipe and thus does not tend to push the pipe to the open position. Further, the O-ring seals, which may be substantially conventional, may withstand significant pressures. This is in contrast to existing side access lubricators provided with hinged doors, which require extensive seals and door retainers which will withstand substantial pressure forces acting on the door.

It will also be apparent to those of skill in the art that the above-described embodiment is merely exemplary of the present invention, and that various modifications and improvements may be made thereto without departing from the scope of the present invention.

What is claimed is:

1. A lubricator comprising a tubular body having ends defining openings to permit an elongate support member extending from surface into a well bore to pass through the lubricator, said tubular body further defining a side access port for inserting or retrieving a tool, and a tubular sleeve mounted on the body and movable between a first position in which a wall portion of the sleeve closes the body port, and a second position in which the body port is open, permitting access to the body interior.

2. The lubricator of claim 1, further comprising seal means for providing a pressure-tight seal between the sleeve and the body when the sleeve is in the first position.

3. The lubricator of claim 2, wherein the sleeve is axially movable relative to the body and the seal means includes annular seals, at least one seal being provided above the port and at least one seal being provided below the port.

4. The lubricator of claim 3, wherein said annular seals are provided on the body above and below the body port.

5. The lubricator of claim 4, wherein said annular seals are positioned adjacent the ends of the sleeve when the sleeve is in the first position.

6. The lubricator of claim 3, wherein said annular seals are located in grooves formed in the body.

7. The lubricator of claim 1, further including means for moving the sleeve between the first and second positions.

8. The lubricator of claim 7, wherein the means for moving the sleeve include a piston and cylinder arrangement.

9. The lubricator of claim 8, wherein a pair of pistons and cylinders is provided, one cylinder being mounted to each side of the body and sleeve.

10. The lubricator of claim 1, wherein the body and the sleeve are cylindrical.

11. The lubricator of claim 1, wherein the access port is elongate and extends axially of the body.

12. The lubricator of claim 1, further comprising means for mounting to body in a rig.

13. The lubricator of claim 12, wherein the means for mounting the body include flanges at upper and lower ends of the body.

14. A lubricator comprising:

a tubular body having ends defining openings to permit an elongate support member extending from surface into a well bore to pass through the lubricator, said tubular body further defining an axially extending elongate side access port for inserting or retrieving a tool;

a tubular sleeve mounted on the body and axially movable between a first position in which a wall portion of the sleeve closes the body port, and a second position in which the body port is open, permitting access to the body interior;

annular seals for providing sealing between the sleeve and the body when the sleeve is in the first position, at least one seal being provided above the port and at least one seal being provided below the port; and means for moving the sleeve between the first and second positions.

15. The lubricator of claim 14, wherein the means for moving the sleeve include a piston and cylinder arrangement.

16. A lubricator comprising:

a tubular body having ends defining openings to permit an elongate support member extending from surface into a well bore to pass through the lubricator, said tubular body further defining a side access port for inserting or retrieving a tool;

a tubular sleeve mounted on the body and movable between a first position in which a wall portion of the sleeve closes the body port, and a second position in which the body port is open, permitting access to the body interior; and seal means for providing a pressure-tight seal between the sleeve and the body when the sleeve is in the first position, wherein the sleeve is axially movable relative to the body and the seal means includes annular seals, at least one seal being provided above the port and at least one seal being provided below the port.

17. A lubricator comprising a tubular body having ends defining openings to permit an elongate support member extending from surface into a well bore to pass through the lubricator, said tubular body further defining a side access port for inserting or retrieving a tool, and a tubular sleeve mounted on the body and movable between a first position in which a wall portion of the sleeve closes the body port, and a second position in which the body port is open, permitting access to the body interior, and wherein the access port is elongate and extends axially of the body.

18. A lubricator comprising a tubular body having ends defining openings to permit an elongate support member extending from surface into a well bore to pass through the lubricator, said tubular body further defining a side access port for inserting or retrieving a tool, and a tubular sleeve mounted externally of the body and movable between a first position in which a wall portion of the sleeve closes the body port, and a second position in which the body port is open, permitting access to the body interior.

19. A lubricator comprising a tubular body having ends defining openings to permit an elongate support member extending from surface into a well bore to pass through the lubricator, said tubular body further defining an interior chamber for receiving an elongate support member, the body further defining a side access port providing access to said chamber for inserting or retrieving a tool, and a tubular sleeve mounted on the body and movable between a first position in which a wall portion of the sleeve closes the body port and isolates the interior chamber, and a second position in which the body port is open, permitting access to the interior chamber and an elongate support member therein.

* * * * *